United States Patent [19]

Borghesi

[11] Patent Number: 4,569,654

[45] Date of Patent: Feb. 11, 1986

[54] DUAL PURPOSE LIGHTER FOR HOUSEHOLD USE

[75] Inventor: Giancarlo Borghesi, Brescia, Italy

[73] Assignee: Enrico Buzzi, Concesio BS, Italy

[21] Appl. No.: 612,231

[22] Filed: May 21, 1984

[30] Foreign Application Priority Data

Nov. 11, 1983 [IT] Italy ..... 23689 A/83

[51] Int. Cl.[4] ..... F23Q 7/12

[52] U.S. Cl. ..... 431/255

[58] Field of Search ..... 431/255

[56] References Cited

U.S. PATENT DOCUMENTS 4,292,021 9/1981 Miyagawa ..... 431/255

*Primary Examiner*—Carroll B. Dority, Jr.

*Attorney, Agent, or Firm*—Guido Modiano; Albert Josif

[57] ABSTRACT

There is disclosed a dual purpose lighter for household use, which comprises a box-like housing containing a spark generating cartridge and a gas supply reservoir, the box-like housing also having a window formed therein for accommodating a triggering pushbutton. The triggering pushbutton has a selector effective to occupy either a first position, whereby the pushbutton will only trigger the cartridge, or a second position, whereby on operating the pushbutton, the cartridge is triggered and the delivery valve of the reservoir activated to issue a flame from the lighter.

7 Claims, 5 Drawing Figures

DUAL PURPOSE LIGHTER FOR HOUSEHOLD USE

BACKGROUND OF THE INVENTION

This invention relates to a dual purpose lighter for household use.

As is known, there are currently commercially available lighters for household use which are operated to generate a spark for igniting gas appliances, or alternatively to issue, directly from the lighters themselves, a small flame which may be used to ignite gas burning ovens, water heaters, and so on.

With such prior designs, to exclude gas delivery by the lighter, and accordingly prevent the flame from issuing therefrom, one is to act on the gas delivery adjustment washer of the lighter such as to practically shut off the delivery valve.

This procedure involves considerable time for adjusting the lighter, while, by constantly manipulating the adjustment washer of the delivery valve, the valve itself may become damaged and cause obvious trouble.

Another drawback of prior lighters is that, with currently used designs, where a lighter is left to children, they could inadvertently open the gas delivery valve and incur potential danger.

SUMMARY OF THE INVENTION

It is an object of this invention to obviate such prior drawbacks by providing a dual purpose lighter for household use, which affords the faculty of switching, in a most simple and quick manner, from the spark generating mode of operation of the lighter over to the flame issuing mode.

It is another object of the invention to provide a lighter which is constructed to afford good safeguarding features against careless handling, since the operation involved to switch from one mode to the other of the lighter, albeit quite simple, cannot be easily performed by a child.

A further object of this invention is to provide a dual purpose lighter for household use, which can give, on account of its constructional features, full assurance of being reliable and safe to use.

A not unimportant object of this invention is to provide a lighter which may be readily manufactured from commercially available materials, and is highly competitive from a purely economical standpoint.

These and other objects, such as will be apparent hereinafter, are achieved by a dual purpose lighter for household use, according to the invention, characterized in that it comprises a box-like housing containing a spark generating cartridge and a gas supply reservoir, said box-like housing defining a window wherethrough access can be had to a triggering pushbutton, said pushbutton being provided with a selector adapted to be moved into a first position, whereby on operating said pushbutton said cartridge only is triggered, and a second position, whereby on operating said pushbutton, said cartridge is triggered and the delivery valve of said reservoir activated to issue a flame from said lighter.

BRIEF DESCRIPTION OF THE DRAWINGS

Further features and advantages will be more readily understood from the following description of a preferred, but not exclusive, embodiment of a dual purpose lighter for household use, as illustrated by way of example and not of limitation in the accompaning drawing, where.

DESCRIPTION OF THE PREFERRED EMBODIMENTS

Figures 1, 2, 3, 4, 5:
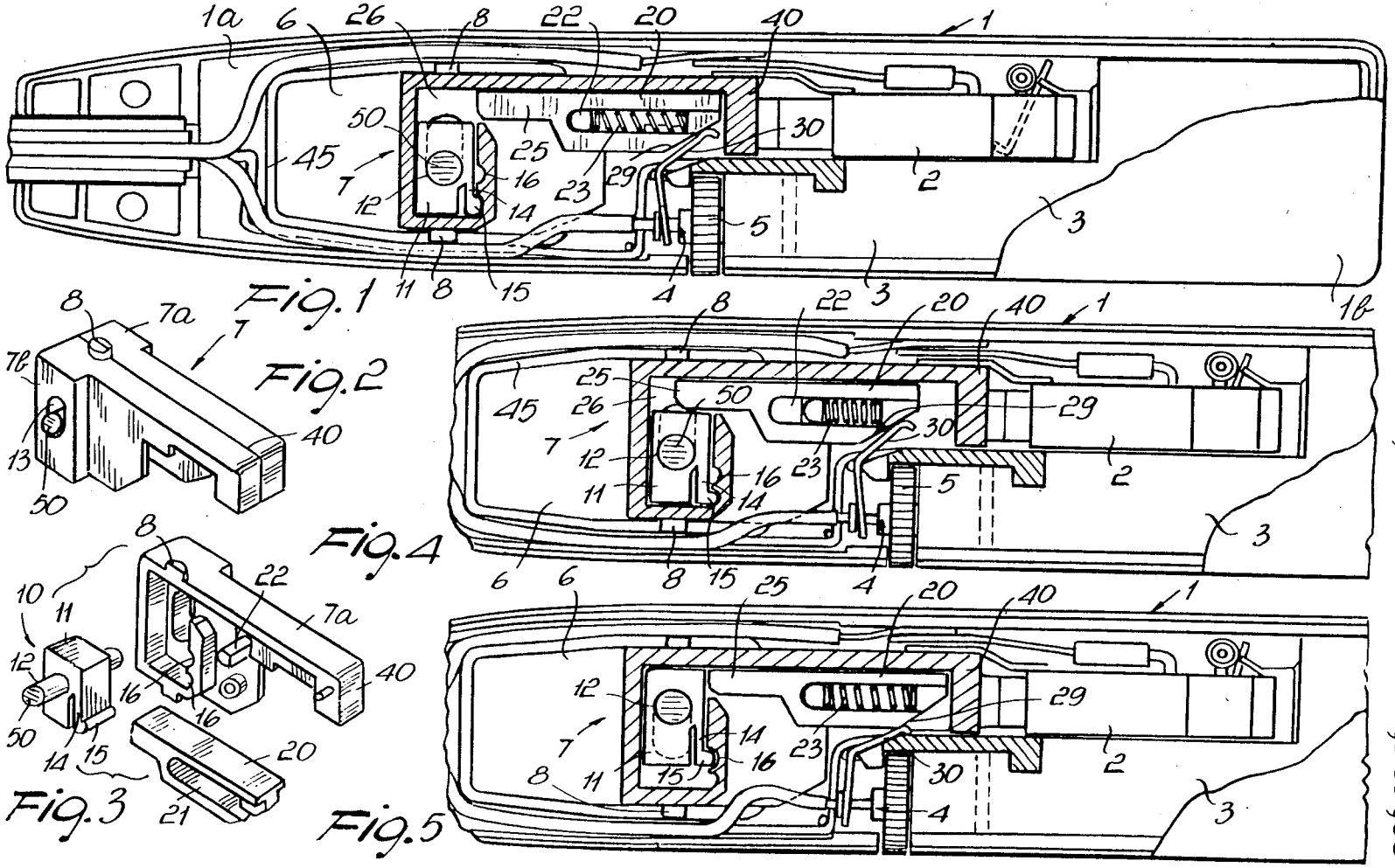
FIG. 1 is a partly sectional view of the lighter of this invention, shown in the inoperative condition thereof.
FIG. 2 is a perspective view of the triggering pushbutton.
FIG. 3 is an exploded perspective view of the triggering pushbutton, showing the selector thereof.
FIG. 4 is a sectional view through this lighter, taken with the selector in said first position.
FIG. 5 shows the lighter with the selector in its second operating position.

Making reference to the drawing views, a dual purpose lighter for household use, according to this invention, comprises a box-like housing, generally designated with the reference numeral 1, which, as is common practice, has a substantially elongate shape. As usually the box-like housing comprises two half-shells 1*a* and 1*b*, whereas the half-shell 1*b* is partly cut-away for a better comprehension of the invention.

Provided inside the box-like housing 1 is a cartridge 2 for generating a spark, which is advantageously a piezoelectric cartridge.

Again inside the box-like housing 1, there is a liquefied gas supply reservoir 3 which includes a delivery valve 4 being acted upon by a flame intensity adjusting washer 5, made accessible from outside said box-like housing.

The box-like housing is formed, at a middle portion thereof, with a window 6 accommodating a triggering pushbutton, generally indicated at 7, which is mounted for a sliding movement within said window to control, as explained hereinafter, operation of the cartridge 2 and gas delivery valve 4.

The pushbutton 7, as shown best in FIGS. 2 and 3, comprises two half-shells 7*a* and 7*b* which define a pair of pegs 8 serving as a guide element for the sliding movement of the pushbutton. For this purpose the half-shells 1*a* and 1*b* present, at three sides of said window, ridges 45 extending toward the interior of the lighter and leaving a little clearance therebetween at least on the two sides thereof extending longitudinally so as to define guiding slots for the pegs 8.

A mode selector 10 is provided inside the pushbutton and comprises a small block 11 carrying pegs 12 which protrude out of a slot 13 defined by the half-shells and are effective to allow the selector to be positioned in either of two different operating positions.

The block 11 further includes an elastic reed portion 14 having an enlarged end 15 intended to be received in receptacles 16 formed on the interiors of the half-shells 7*a* and 7*b* to hold the selector securely in a preset position.

Inside the pushbutton 7, there is mounted for sliding movement an actuator 20 of elongate configuration having an oblong slot 21 wherethrough a detent peg 22 may be inserted which is defined by the halfshells 7*a* and 7*b*, thereby serving as a guide element for the sliding movement of the actuator 20, as explained hereinafter. Also provided is a spring 23 acting between the detent peg 22 and the outer end of the slot 21 and functioning as an elastic bias element for the sliding movement.

The actuator 20 has at its rearward end, i.e. the opposite end to that facing the selector 10, a tapering formation 29 which can engage with one end of a small lever 30 abutting with a middle portion thereof against a projection of the box-like housing 1 so as to oscillate around its middle portion, said lever 30 acting at the other end on the delivery valve 4.

By moving the selector into its first position (FIG. 4), it occurs that on applying a pressure to the pushbutton 7, the forward lug 25 of the actuator 20 enters the space 26, defined between the block 11 and top wall of the pushbutton itself, thereby no direct thrust is exerted on the actuator 20 and the oscillating lever 30 can counterbalance the elastic bias by the spring 23 without opening the gas delivery valve.

In this condition, the rearward shank 40 of the pushbutton 7 will act on the piezoelectric cartridge 2 to generate a spark.

By moving the selector 10 into its second position or operating position (FIG. 5), it occurs that on operating the pushbutton 7 the contact established between the lug 25 and block 11 will also impart a translatory movement on the actuator 20, which actuates with its tapered end 29 the lever 30, causing it to rotate and open the gas delivery valve and produce ignition of a flame from the lighter.

It should be added to the foregoing that the pegs 12 slightly protruding from the pushbutton through the slots 13 are formed externally with knurlings 50 adapted to improve the grip on the selector for switching from the first to the second position, and viceversa.

It may be appreciated from the above description that the invention achieves its objects, and in particular that the dual purpose lighter for household use, according to this invention, enables its user to easily and quickly switch from one over to the other mode of operation, thus affording, where required, generation of a flame from the lighter without involving direct manipulation of the gas delivery valve.

The invention as disclosed is susceptible to many modifications and changes without departing from the scope of the instant inventive idea.

Furthermore, all of the details may be replaced with other, technically equivalent, elements.

In practicing the invention, the materials used, provided that they are compatible with a specific intended application, and the dimensions and contingent shapes, may be selected as desired to meet individual requirements.

I claim:

1. A dual purpose lighter for household use, comprising a box-like housing containing a spark generating cartridge, a gas supply reservoir having a delivery valve, and a triggering pushbutton, said box-like housing having a window at said triggering pushbutton for allowing actuation thereof, said pushbutton being provided with a selector movable into a first position, and means whereby on operating said pushbutton said cartridge only is triggered, and means in a second position, whereby on operating said pushbutton, said cartridge is triggered and said delivery valve of said reservoir activated to issue a flame from said lighter.

2. A dual purpose lighter for household use, according to claim 1, characterized in that said triggering pushbutton comprises two half-shells coupled together to define a rearward shank acting on said cartridge, at least one half-shell having at a forward portion thereof a slot wherethrough a crosswise peg extends which is connected to said selector including a small block slidably accommodated within said triggering pushbutton.

3. A dual purpose lighter for household use, according to claim 1, wherein said selector comprises a small block having an elastic lug provided at a free end thereof with a projection elastically fitting into a pair of seatings on the pushbutton locating said selector at said first and/or second positions.

4. A dual purpose lighter for household use, according to claim 1, characterized in that it comprises inside said pushbutton, an actuator slidably accommodated within said pushbutton and being provided with an oblong slot accommodating a detent rigid with the pushbutton, a spring arranged within said oblong slot acting with an end thereof on said detent and with another end thereof on the bottom of said oblong slot.

5. A dual purpose lighter for household use, according to claim 1, comprising an actuator slidably accommodated in said pushbutton, said actuator having at a rearward end thereof a tapering formation acting by contact on one end of an oscillating lever connected with another end thereof to said gas delivery valve of said gas supply reservoir.

6. A dual purpose lighter for household use, according to claim 1, wherein said selector comprises a small block and said pushbutton contains a slidable actuator having a forward lug facing the selector and a rearward tapering formation acting by contact on one end of an oscillating lever connected with an end thereof to said gas delivery valve, said selector in said first position defining a region between the block and an inner wall of said pushbutton, wherein the forward lug is received not transferring to the actuator a translatory movement of said pushbutton during the oscillation thereof, in said first position a return spring arranged in an oblong slot of said actuator being compressed and counterbalanced by the elastic bias from the oscillating lever, without operation of the gas delivery valve.

7. A dual purpose lighter for household use, according to claim 1, wherein said selector comprises a small block and said pushbutton contains a slidable actuator having a forward lug facing the selector and a rearward tapering formation acting by contact on one end of an oscillating lever connected with an end thereof to said gas delivery valve, the forward lug of the actuator, with the selector in said second position, acting by contact against the block, with consequent translation of said actuator on translating said pushbutton, the translation of said actuator generating an oscillation of the oscillating lever and consequent activation of the delivery valve to issue a flame from said lighter.

* * * * *